US007036570B2

(12) United States Patent
Korth et al.

(10) Patent No.: US 7,036,570 B2
(45) Date of Patent: May 2, 2006

(54) MULTIPLE ROW HEAT EXCHANGER USING "END-TO-END" OR "TUBE TOUCHING" POSITIONING OF THE TUBES FOR ROW SPACING

(75) Inventors: Jay Korth, Kenosha, WI (US); Geoff Smith, Jackson, TN (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/690,009

(22) Filed: Oct. 21, 2003

(65) Prior Publication Data

US 2005/0082050 A1 Apr. 21, 2005

(51) Int. Cl.
*F28F 9/02* (2006.01)

(52) U.S. Cl. ..... 165/173; 165/175; 29/890.043

(58) Field of Classification Search ..... 165/173, 165/175, 178; 29/890.043
See application file for complete search history.

(56) References Cited

U.S. PATENT DOCUMENTS 2,984,456 A * 5/1961 Young ..... 165/145
4,577,684 A * 3/1986 Hagemeister ..... 165/172
4,771,825 A * 9/1988 Chen et al. ..... 165/151
5,123,482 A * 6/1992 Abraham ..... 165/173
5,150,520 A * 9/1992 DeRisi ..... 29/890.043
5,301,748 A * 4/1994 Potier ..... 165/173
5,318,113 A * 6/1994 Potier ..... 165/173
5,329,988 A * 7/1994 Juger ..... 165/153
5,423,112 A * 6/1995 Murphy et al. ..... 29/890.043
RE35,098 E * 11/1995 Saperstein ..... 29/890.043
6,263,570 B1 * 7/2001 Cazacu ..... 29/890.043
6,415,854 B1 * 7/2002 Falkeno et al. ..... 165/152
2002/0023730 A1 * 2/2002 Ehlers et al. ..... 165/124

* cited by examiner

*Primary Examiner*—Teresa J. Walberg
(74) *Attorney, Agent, or Firm*—The Webb Law Firm

(57) ABSTRACT

A method of increasing thermal efficiency around a plurality of tubes in a heat exchanger. The method includes the steps of providing a plurality of tubes having a predetermined end configuration and a header having a number of openings corresponding to the plurality of tube. The openings are disposed in an end-to-end array wherein the predetermined end configurations touch. Finally the method secures an end of each of the plurality of tubes into a corresponding one of each of the openings in the header.

19 Claims, 2 Drawing Sheets

MULTIPLE ROW HEAT EXCHANGER USING "END-TO-END" OR "TUBE TOUCHING" POSITIONING OF THE TUBES FOR ROW SPACING

FIELD OF THE INVENTION

The present invention generally relates to, but is not limited to, radiators, shell and tube type heat exchangers, charge air coolers, oil coolers, and fuel coolers.

More particularly, the invention relates to the webbing in a CT or Serpentine fin core with a flat-round joint to header application. Even more particularly, the present invention relates to a method of increasing thermal efficiency around a plurality of tubes in a heat exchanger, and minimizing the web in a header around such plurality of tubes.

BACKGROUND OF THE INVENTION

Current CT and Serpentine style fin core radiators have a plurality of tubes that are arranged in an array that are perpendicular to each other. This array is not equally spaced about the centerline of the tube ends, and therefore results in having different spacing between the tube pitch, and row pitch. Each tube column starts at the same point with respect to the airflow, at the front of the core. The tube pitch, and the row pitch, is symmetrical, at 90-degrees about the centerline, for each row and column.

These CT and Serpentine style fin core radiators use multiple rows and leave a space in-between these rows which require a fin to be placed in-between the rows. This fin is not effective at rejecting heat. However, this space is required due to constraints in manufacturing the header. Unfortunately, there is presently no means of improving thermal efficiency while minimizing this space, otherwise known as the webbing, in-between the rows.

SUMMARY OF THE INVENTION

The present invention provides a method of increasing thermal efficiency around a plurality of tubes in a heat exchanger. The method comprises the steps of providing a plurality of tubes having a predetermined end configuration and a header having a number of openings corresponding to the plurality of tube. The openings are disposed in an end-to-end array wherein the predetermined end configurations touch. Finally the method secures an end of each of the plurality of tubes into a corresponding one of each of the openings in the header.

Additionally, the present invention further provides a method of increasing thermal efficiency around a plurality of tubes in a heat exchanger. The method comprises the steps of providing a plurality of tubes having a predetermined end configuration and a header having a number of openings corresponding to the plurality of tubes. The openings are disposed in an array wherein the plurality of tubes touch. Finally the method secures an end of each of the plurality of tubes into a corresponding one of each of the openings in the header.

Furthermore, the present invention provides a method of increasing thermal efficiency around a plurality of tubes in a heat exchanger. The method comprises the steps of providing a plurality of tubes having a predetermined end configuration and a header having a number of openings corresponding to the plurality of tubes. The openings are disposed in at least one of an end to end array wherein the predetermined end configurations touch and an array wherein the plurality of tubes touch. Finally the method secures an end of each of the plurality of tubes into a corresponding one of each of the openings in the header.

OBJECTS OF THE INVENTION

It is, therefore, a primary object of the present invention to provide a method of increasing thermal efficiency around a plurality of tubes in a heat exchanger that increases airflow around such plurality of tubes.

Another object of this invention is to provide a method of increasing thermal efficiency around a plurality of tubes in a heat exchanger which permit a reduction in tolerance between the column pitches to aid in manufacturing.

Another object of this invention is to provide a method of increasing thermal efficiency around a plurality of tubes in a heat exchanger which minimizes the webbing between the tubes to aid in airflow around such tubes.

Yet another object of this invention is to provide a method of increasing thermal efficiency around a plurality of tubes in a heat exchanger which improves heat exchanger life-cycle.

Yet another object of this invention is to provide a method of increasing thermal efficiency around a plurality of tubes in a heat exchanger which enables additional tubes to be placed in the same amount of envelope space.

Still another object of this invention is to provide a method of increasing thermal efficiency around a plurality of tubes in a heat exchanger which allows for smaller more compact heat exchanger designs.

Still another object of this invention is to provide a method of increasing thermal efficiency around a plurality of tubes in a heat exchanger which aids the manufacturing process and allows for a reduction in time to produce such heat exchangers.

In addition to the above-described objects and advantages of the method for increasing thermal efficiency of this invention, various other objects and advantages of the present invention will become more readily apparent to those persons who are skilled in the same and related arts from the following more detailed description of the invention, particularly, when such description is taken in conjunction with the appended claims.

DETAILED DESCRIPTION OF THE PREFERRED EMBODIMENT

Figure 1:
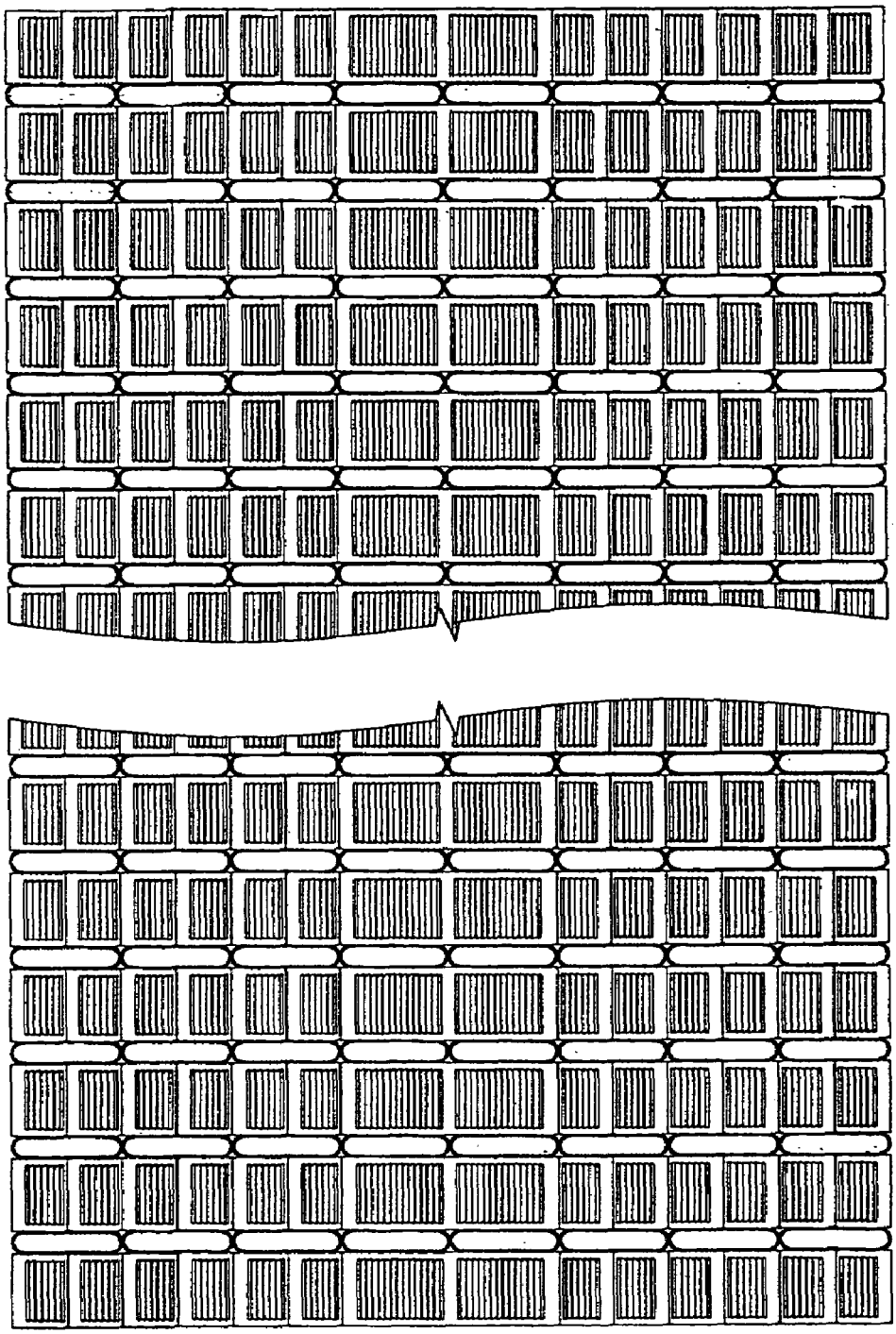
FIG. 1 illustrates an arrangement of tubes in a preferred embodiment of the invention.
Figure 3:
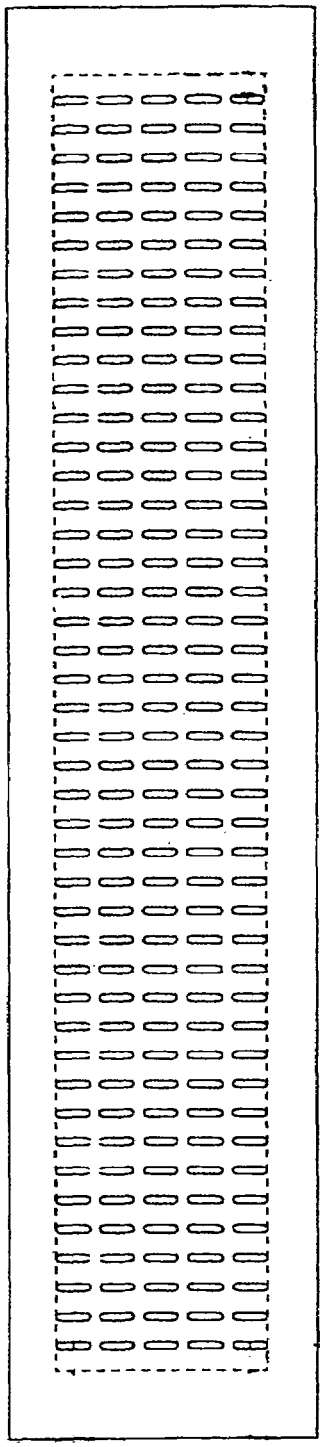
FIG. 3 PRIOR ART
FIG. 3 illustrates an end view of an arrangement of tubes used in the prior art.
Figure 2:
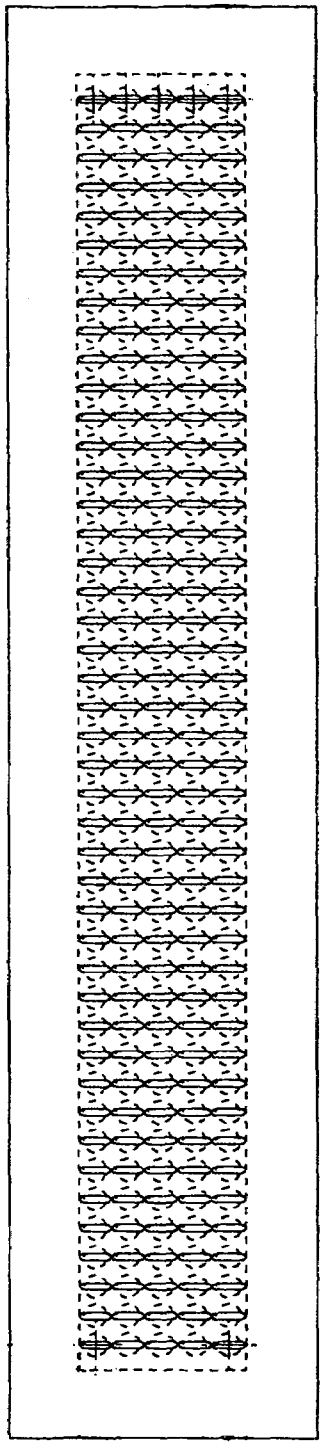
FIG. 2 illustrates an end view of an arrangement of tubes in accordance with a preferred embodiment of the invention.

The present invention includes a method of increasing thermal efficiency around a plurality of tubes in a heat exchanger. The method includes the steps of providing a plurality of tubes having a predetermined end configuration and a header having a number of openings corresponding to the plurality of tubes. The openings are disposed in an end-to-end array wherein the predetermined end configurations touch. These predetermined end configurations are generally oblong in shape. Furthermore, the plurality of tubes are generally oblong in shape substantially an entire length thereof.

The end-to-end array is determined by the tube height and row pitch of such tubes. Wherein the row pitch, which is based on the tube height, is spaced to allow for a minimal amount of web material between the predetermined number of openings. Finally the method secures an end of each of the plurality of tubes into a corresponding one of each of the openings in the header. The step of securing further includes creating a fluid tight seal.

In order to create the fluid tight seal the method further includes the steps of at least one of mechanical bonding and non-mechanical bonding of the plurality of tubes ends into the openings in the header. The process of mechanical bonding includes at least one of rolling and machining, and the process for non-mechanical bonding includes at least one of welding, brazing, and adhesive.

The present invention further includes a method of increasing thermal efficiency around a plurality of tubes in a heat exchanger. This method includes the steps of providing a plurality of tubes having a predetermined end configuration and a header having a number of openings corresponding to the plurality of tubes. The openings are disposed in an array wherein the plurality of tubes touch. These predetermined end configurations are generally oblong in shape.

The array wherein the plurality of tubes touch is determined by the tube height and row pitch of such tubes. Wherein the row pitch, which is based on the tube height, is spaced to allow for a minimal amount of web material between the predetermined number of openings.

Finally the method secures an end of each of the plurality of tubes into a corresponding one of each of the openings in the header. In order to secure the tubes the step further includes creating a fluid tight seal. Creating a fluid tight seal further includes the steps of at least one of mechanical bonding and non-mechanical bonding of the plurality of tubes ends into the openings in the header.

Finally the present invention includes a method of increasing thermal efficiency around a plurality of tubes in a heat exchanger. Wherein this method includes the steps of providing a plurality of tubes having a predetermined end configuration, and a header having a number of openings corresponding to the plurality of tubes. The predetermined end configurations are generally oblong in shape. These openings are disposed in at least one of an end to end array wherein the predetermined end configurations touch, and an array wherein the plurality of tubes touch.

Finally, the method secures an end of each of the plurality of tubes into a corresponding one of each of the openings in the header. This step of securing further includes creating a fluid tight seal, in order to create the fluid tight seal the method further includes the steps of at least one of mechanical bonding and non-mechanical bonding of the plurality of tubes ends into the openings in the header.

While both the presently preferred and a number of alternative embodiments of the present invention have been described in detail above it should be understood that various other adaptations and modifications of the present invention can be envisioned by those persons who are skilled in the relevant art without departing from either the spirit of the invention or the scope of the appended claims.

We claim:

1. A method of increasing thermal efficiency around a plurality of tubes in a heat exchanger, said method comprising the steps of:

a) providing a plurality of tubes having a predetermined end configuration;

b) providing a header having a number of openings corresponding to said plurality of tubes, said openings disposed in an end-to-end array wherein said predetermined end configurations touch; and c) securing an end of each of said plurality of tubes into a corresponding one of each of said openings in said header.

2. A method, according to claim 1, wherein said method includes the additional step of determining a tube height.

3. A method, according to claim 2, wherein said method further includes determining a row pitch based on said tube height.

4. A method, according to claim 3, wherein said method further includes arranging said plurality of tubes such that said row pitch is spaced to allow for a minimal amount of web material between said predetermined number of openings.

5. A method, according to claim 1, wherein said step (c) further includes the step of creating a fluid tight seal.

6. A method, according to claim 5, wherein said step of creating said fluid tight seal includes at least one of mechanical bonding and non-mechanical bonding of the ends of said plurality of tubes into said openings in said header.

7. A method, according to claim 6, wherein said mechanical bonding includes at least one of rolling and machining.

8. A method, according to claim 6, wherein said non-mechanical bonding includes at least one of welding, brazing, and adhesive.

9. A method, according to claim 1, wherein said predetermined end configuration is generally oblong in shape.

10. A method, according to claim 1, wherein each of said tubes in the plurality of tubes provided in step (a) is generally oblong in shape along substantially an entire length thereof.

11. A method of increasing thermal efficiency around a plurality of tubes in a heat exchanger, said method comprising the steps of:

a) providing a plurality of tubes having a predetermined end configuration;

b) determining a row pitch based on a height of said plurality of tubes;

c) providing a header having each of a row pitch determined in step (b) and a number of openings corresponding to said plurality of tubes, said openings disposed in an array wherein said plurality of tubes touch; and d) securing an end of each of said plurality of tubes into a corresponding one of each of said openings in said header.

12. A method, according to claim 11, wherein said method further includes the additional step of arranging said plurality of tubes such that said row pitch is spaced to allow for a minimal amount of web material between said predetermined number of openings in said header.

13. A method, according to claim 11, wherein step (d) further includes the step of creating a fluid tight seal.

14. A method, according to claim 13, wherein said step of creating said fluid tight seal includes at least one of mechanical bonding and non-mechanical bonding of the ends of said plurality of tubes into said openings in said header.

15. A method, according to claim 11, wherein said predetermined end configuration is generally oblong in shape.

16. A method of increasing thermal efficiency around a plurality of tubes in a heat exchanger, said method comprising the steps of:

a) providing a plurality of tubes having a predetermined end configuration;

b) providing a header having a number of openings corresponding to said plurality of tubes, said openings disposed in at least one of an end-to-end array wherein said predetermined end configurations touch and an array wherein said plurality of tubes touch; and c) securing an end of each of said plurality of tubes into a corresponding one of each of said openings in said header.

17. A method, according to claim 16, wherein step (c) further includes the step of creating a fluid tight seal.

18. A method, according to claim 17, wherein said step of creating said fluid tight seal includes at least one of mechanical bonding and non-mechanical bonding of the ends of said plurality of tubes into said openings in said header.

19. A method, according to claim 16, wherein said predetermined end configuration is generally oblong in shape.

* * * * *